United States Patent [19]

Chappell

[11] 4,415,314

[45] Nov. 15, 1983

[54] METERING PUMP

[75] Inventor: Anthony G. Chappell, Mosman, Australia

[73] Assignee: Wellcome Australia Limited, Sydney, Australia

[21] Appl. No.: 397,203

[22] Filed: Jul. 12, 1982

Related U.S. Application Data

[63] Continuation of Ser. No. 144,320, Apr. 28, 1980.

[30] Foreign Application Priority Data

May 4, 1979 [AU] Australia ..... PD8634

[51] Int. Cl.[3] ..... F04F 1/02; F04B 35/02; F04B 43/08; E03D 9/02

[52] U.S. Cl. ..... 417/131; 417/337; 417/480; 4/227; 4/228

[58] Field of Search ..... 417/93, 95, 131, 337, 417/429, 474, 475, 480, 479, 478; 222/135, 136; 4/228, 227, 222; 73/224, 225

[56] References Cited

U.S. PATENT DOCUMENTS

| | | | |
|---|---|---|---|
| 1,010,562 | 12/1911 | Woodward | 141/198 X |
| 2,428,912 | 10/1947 | Hulsberg | 417/93 |
| 3,048,121 | 8/1962 | Sheesley | 417/478 X |
| 3,254,797 | 6/1966 | Porter | 417/337 X |
| 4,015,914 | 4/1977 | Kushner et al. | 417/479 X |
| 4,273,261 | 6/1981 | Krueger | 417/429 X |

*Primary Examiner*—Richard E. Gluck
*Assistant Examiner*—Peter M. Cuomo
*Attorney, Agent, or Firm*—Donald Brown; Robert Gammons

[57] ABSTRACT

A fluid pump for location within a reservoir and which is operable with rise and fall of liquid within the reservoir. The pump comprises a tube of a resiliently deformable material, an abutment surface which is engaged by the tube and a float device which is mounted to the tube. Liquid entering the reservoir causes upward movement of the float device and such movement of the float device causes increasing engagement between the tube and the abutment surface. The increasing engagement between the tube and the abutment surface causes the tube to deform resiliently and a localized reduction in the contained volume of the tube is thereby effected to cause expulsion of fluid from the tube. Conversely, as the liquid level falls in the reservoir, the float device moves downwardly to reduce the extent of engagement between the tube and the abutment surface, so that the tube tends to resume its initial contained volume.

5 Claims, 4 Drawing Figures

METERING PUMP

This is a continuation, of application Ser. No. 144,320 filed Apr. 28, 1980.

FIELD OF THE INVENTION

This invention relates to a pump for use in pumping a fluid medium and, desirably, for use in pumping metered quantities of the fluid with successive pumping operations. The invention is applicable to a metering pump which is suitable for use in pumping predetermined quantities of chemical solutions into toilet systems and the like but, whilst the invention is hereinafter described in such context it will be understood that the invention need not be limited exclusively to such applications.

BACKGROUND OF THE INVENTION

The metering of chemicals into toilet systems imposes severe restrictions on the design of the equipment if it is to be independent of additional sources of power, be capable of operating consistently for long periods between service calls and be inexpensive. Methods which have been used hitherto comprise various ways of dissolving solid or liquid chemicals by direct contact with water which is used for flushing toilet systems and of emitting perfumes or deoderants into the atmosphere. Such systems produce inconsistent results because excessively high concentrations of chemicals are dissolved in the flushing water following initial charging of the systems and ineffectively weak solutions are produced toward the end of the charge life. Thus, for only a relatively short period in the life of any one charge is the optimum chemical concentration achieved.

The present invention seeks to provide a fluid pump which is suitable for use in overcoming or at least alleviating the above stated problem.

SUMMARY OF THE INVENTION

Broadly defined, the present invention provides a fluid pump for location within a liquid reservoir and which is operable with rise and fall of liquid within the reservoir. The pump comprises a tube of resiliently deformable material, an abutment surface which is engageable by the tube, and a float device mounted to the tube. The float device is arranged to cause localised engagement between the tube and the abutment surface with movement in one direction of liquid within the reservoir, whereby the tube is caused to deform resiliently and a localised reduction in the contained volume of the tube is thereby effected to cause expulsion of a first fluid from the tube.

In operation of the pump, when the liquid within the reservoir moves in one direction (e.g. rises) a portion of the fluid within the tube is expelled by compression of the tube. Then, with movement of the liquid in the reservoir in the opposite direction (e.g. fall of liquid), the float device follows the liquid movement and causes the tube to move away from engagement with the abutment surface. This in turn allows the tube to resume its initial configuration and replenishment of the first fluid volume in the tube occurs. Replenishment of the first fluid volume in the tube may be effected by inflow of a fresh charge of fluid or by the previously expelled fluid being drawn back into the tube.

PREFERRED FEATURES OF THE INVENTION

In accordance with a preferred aspect of the invention, the tube is coupled to a valved pumping chamber which is operable to displace a second fluid with transfer of the first fluid between the tube and the pumping chamber.

In accordance with a particularly preferred aspect of the invention, the valved pumping chamber is connected to a secondary reservoir which contains the second fluid (preferably a liquid) which is pumped into the first mentioned liquid reservoir by way of the pumping chamber and by operation of the fluid pump during successive discharging and charging operations of the first liquid reservoir. The invention when in this form may be embodied in a mechanism for supplying additives to a toilet flushing system, with the liquid reservoir being coupled to a flush pipe of the system.

The fluid pump may comprise two said tubes of resiliently deformable material, with each tube being connected to a separate float device or with both tubes being connected to one float device. Then, each of the tubes may be coupled to a respective pumping chamber, with the two pumping chambers being arranged to pump fluid from separate (secondary and tertiary) reservoirs.

The fluid pump preferably includes means for selectively limiting the degree of movement of the float device within the liquid reservoir, whereby the float device may be restrained against moving for the full extent of liquid movement within the reservoir.

The invention will be more fully understood from the following description of a preferred embodiment thereof, the description being given with reference to the accompanying drawings.

DETAILED DESCRIPTION OF THE INVENTION

Figure 2:
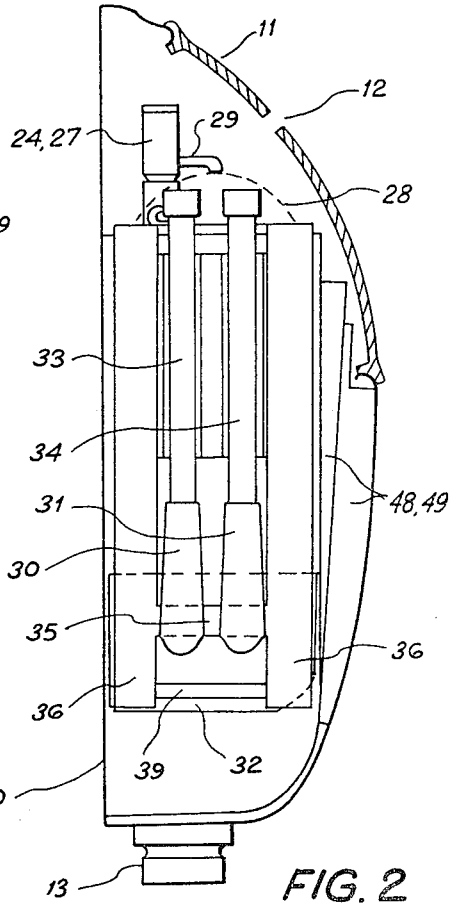
FIG. 2 shows a side view of the same installation.

The arrangement illustrated in the drawings comprises a primary reservoir or housing 10 which is fitted with a removable cover 11. The cover is apertured as indicated by numeral 12 to permit escapement of gas or vapour from the reservoir and into the atmosphere.

The reservoir 10 is connectable by way of a union 13 to a branch conduit (not shown) of a water closet or urinal flush pipe (also not shown). Water enters the reservoir 10 when flush water flows through the flush pipe and then returns to the flush pipe from the reservoir during the final stage of a flushing operation. This operation and the pipe arrangement which is employed is well known and is not further described in this specification.

A float element 14 is located within the reservoir 10 and is connected by a stem 15 to a valve member 16. The float element 14 rises within the chamber 10 with inflowing water and serves to cause engagement of the valve member 16 with its seat when a predetermined quantity of water has entered the reservoir. However, the buoyancy of the float, stem and valve member arrangement is chosen so that the valve member 16 will move away from its seat and permit the water to exit from the reservoir when water flow toward the reservoir (from the flush pipe) ceases.

Secondary and tertiary reservoirs 17 and 18 are located within the primary reservoir 10 and, in combination, occupy about 25–30% of the total contained volume of the primary reservoir 10. The secondary reservoir 17 contains a liquid preparation in the form of a combined detergent/colouring agent/bacteriacide, and the tertiary reservoir 18 contains a liquid perfume. A lid 19 extends over and between the secondary and tertiary reservoirs and is formed with three ports 20, 21 and 22. The ports 20 and 21 serve to permit air flow into the secondary and tertiary reservoirs 17 and 18 respectively, and the port 22 serves to funnel air which is displaced upwardly within the primary reservoir 10 when water flows into that reservoir.

Figure 1:
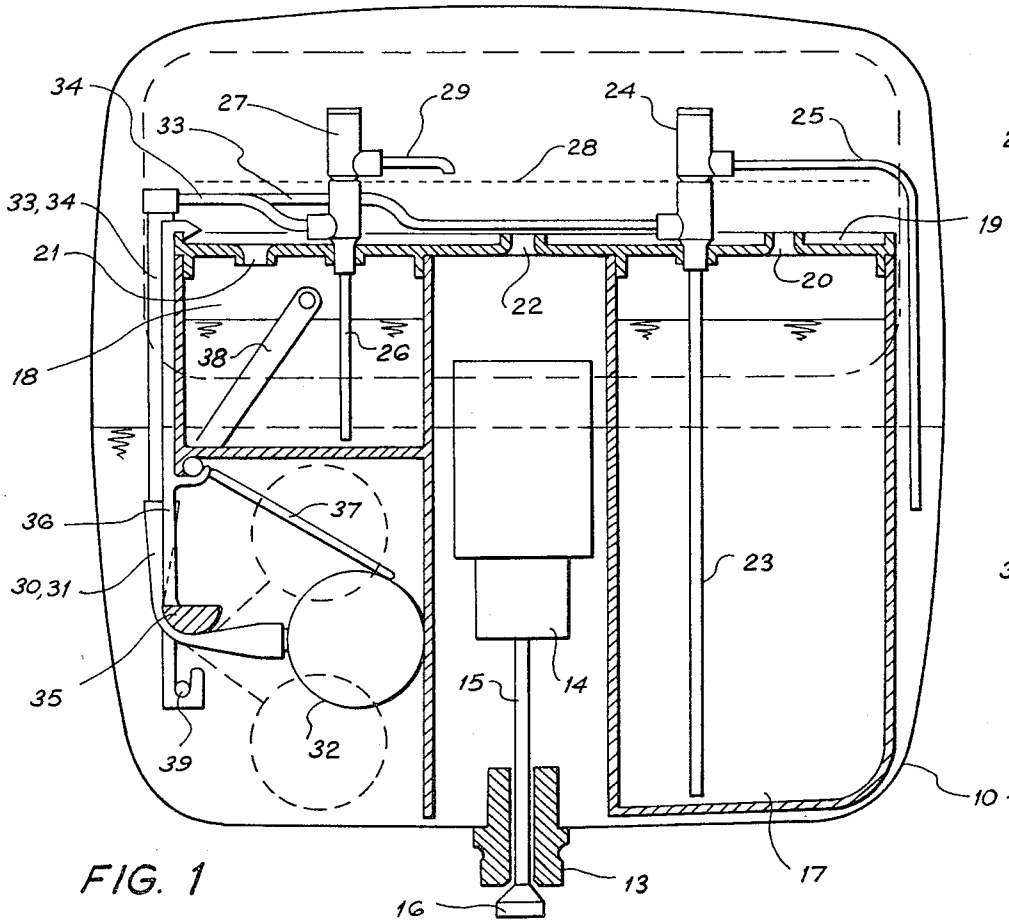
FIG. 1 shows a partly cross-sectioned elevation view of a fluid pump arrangement installed within a liquid reservoir.

A suction tube 23 extends towards the bottom of the secondary reservoir 17 from a first pumping chamber 24, and liquid which is contained within the secondary reservoir 17 is pumped into the primary reservoir 10 by way of the pumping chamber 24 and a discharge tube 25. Simiarly, another suction tube 26 extends toward the bottom of the tertiary reservoir 18 from a second pumping chamber 27, and the liquid which is contained within the tertiary reservoir 18 is pumped onto an absorbant wick 28 by way of the pumping chamber 27 and a discharge tube 29. The wick 28 is located within the upper portion of the reservoir 10, and when water rises within the primary reservoir 10 it tends to expel vaporised perfume through the aperture 12 in the reservoir cover 11. The lid 19 is formed as a shallow trough, as best seen in FIG. 1, and if the wick 28 is saturated to an excessive extent, surplus liquid will drip onto the lid 19 and return to the tertiary chamber 18 by way of the port 21.

The mechanism which controls or effects operation of pumping chambers 24 and 27 is now described, and the construction of the pumping chambers is hereinafter described with reference to FIG. 4.

Two tubes 30 and 31 are connected to a single float device 32 which is located within the lower portion of the primary reservoir 10 and which floats up and down with inflow and outflow of water to and from the primary reservoir. The two tubes 30 and 31 are formed from a resiliently deformable material (such as a plastics material, or natural or synthetic rubber) and is preferably formed from silicon rubber. The tube 30 is connected to the pumping chamber 24 by a conduit 33, and the tube 31 is connected to the pumping chamber 27 by a conduit 34.

An abutment surface which is in the form of a semicircular section bar 35 and which is carried by support elements 36 extends transversely with respect to the tubes 30 and 31. The tubes 30 and 31 engage (i.e. wrap around) the abutment surface 35, and the extent of engagement increases with upward movement of the float device. Thus, when water rises within the reservoir 10, the float device 32 is carried upwardly and increasing engagement occurs between both of the tubes 30 and 31 and the abutment surface 35. The tubes 30 and 31 are thereby caused to deform (i.e. compress) resiliently, and this in turn causes a localised reduction in the contained volume of each tube and expulsion of air from within the tubes. The air which is expelled from the tubes 30 and 31 passes into the pumping chambers 24 and 27 respectively. Conversely, when the water level falls within the reservoir 10, the float device 32 falls with the water, the tubes 30 and 31 tend to move away from the abutment surface 35, and the contained volume of each tube increases. The air which was expelled from the tubes is then drawn back into the tubes to occupy the expanding volume.

Thus, as the water level within the reservoir 10 is successively raised and lowered, a reciprocating air flow is induced in the tubes 30 and 31.

A pivotable lever 37 is provided within the primary reservoir 10 for limiting the upward extent of travel of the float device 32, and a manually operable lever arm 38 is provided for selectively locating the lever 37 in a desired position. The position selected for the lever 37 effectively determines the degree of deformation of the tubes 30 and 31 and hence determines the amount of liquid which is pumped through the pumping chambers 24 and 27 with each charge of water which enters the primary reservoir 10.

A rod 39 is located below and in parallel with the abutment surface 35, and the rod determines the lowermost extent of movement of the float device 32.

Figure 4:
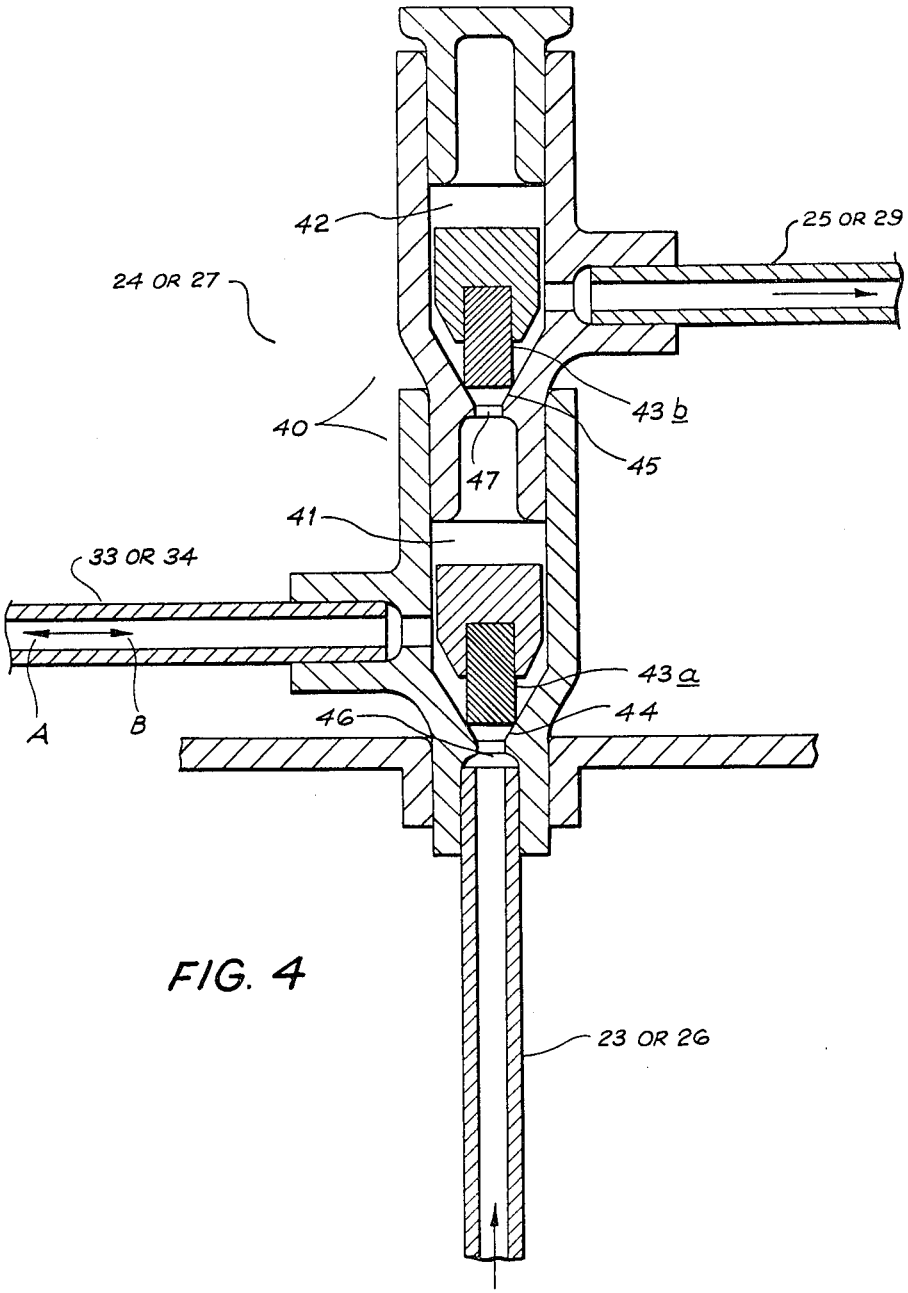
FIG. 4 shows a cross sectioned view of a valved pumping chamber for use in the arrangement of FIG. 1.

Reference is now made to FIG. 4 of the drawings which shows a detailed cross-sectional elevation view which is appropriate to both of the pumping chambers 24 and 27. The pumping chambers are operated by air movement (back and forth) in the tubes 33 and 34, and the chambers serve to pump fluid upwardly through the tubes 23 and 26 to the tubes 25 and 29.

Each pumping chamber comprises a two-part body 40 which includes a lower valve chamber 41 and an upper valve chamber 42. Valve members **43*a* and 43*b* are located in the respective chambers, the valve members permitting unidirectional flow from the tube 23, 26 to the tube 25, 29. When in a static condition, the respective valve members 43*a* and 43*b* engage with seats 44 and 45 to close fluid flow passages 46 and 47**.

When air within the tube 33, 34 flows in the direction of arrow A (that is, responsive to downward movement of the float 32), a condition of reduced pressure is temporarily created within the chamber 41. This causes closure of the valve member **43*b*, opening movement of the valve member 43*a* and suction of liquid into the chamber 41 from the tube 23, 26. Then, when the air flow within the tube 33, 34 is reversed and flows in the direction of arrow B, a positive pressure is established in the chamber 41. This causes closure of the valve 43*a*, and fluid within the chamber 41 is expelled into the chamber 42 by way of the valve member 43*b*. At the same time, any liquid which was previously in the chamber 42 is discharged along the tube 25, 29**.

Thus, reciprocating air movement within the tube 33, 34 is harnessed to cause pumping of liquid from the tube 23 26 to the tube 25, 29.

Figure 3:
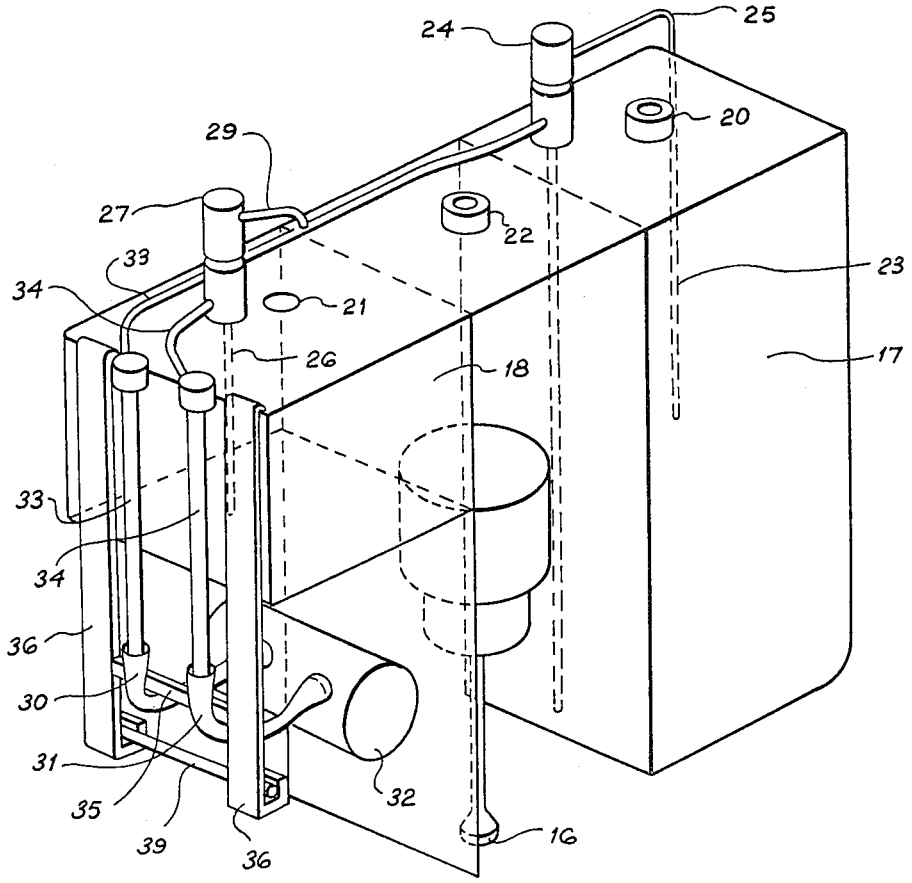
FIG. 3 shows a perspective view of the fluid pump arrangement of FIGS. 1 and 2 when removed from the liquid reservoir.

As indicated in FIG. 3, the secondary and tertiary reservoir 17 and 18 (together with other ancillary elements) are constructed as a sub-assembly and are located as a signle unit within the primary reservoir 10. Two wedge elements 48 and 49 (FIG. 2) are employed to locate and hold the sub-assembly in situ within the primary reservoir.

Although the fluid pump arrangement (including the tubes 30 and 31, the float device 32 and the abutment surface 35) has been described in the context of a metering arrangement for use with a toilet flushing system, it will be appreciated that the pump arrangement has broader application and that it need not be limited to use in the described system.

I claim:

1. A pump positioned in a first liquid reservoir operable by the rise and fall of liquid within the reservoir, said pump comprising a pump chamber having intake and discharge ports and normally closed intake and discharge valves in said ports, a tube formed of resiliently deformable material, said tube having a closed first end and an open second end, said open second end being in communication with the pump chamber, a float device coupled to the tube adjacent the first closed end, the float device, together with the closed first end of the tube, being movable upwardly and downwardly with the rise and fall of liquid within the reservoir, means defining an abutment surface which is engageable by a wall portion of the tube intermediate the first and second ends of the tube, the abutment surface being disposed such that the tube is caused, by engagement with the abutment surface with movement of the liquid in one direction within the reservoir, to be constricted and is caused to expand with movement of the liquid in a direction away from the abutment surface to thus alternately increase the pressure in the pump chamber and decrease the pressure in the pump chamber to thus alternately simultaneously open the intake valve and close the discharge valve and simultaneously close the intake valve and open the discharge valve.

2. A fluid pump according to claim 1 wherein the intake port is connected to a second reservoir containing a liquid so that as the fluid in the first reservoir rises and falls, the liquid in the second reservoir is pumped from the second reservoir into the first reservoir.

3. A fluid pump according to claim 1 wherein there are two pump chambers, two tubes coupled to the respective pump chambers, each of which is alternately restricted and expanded by the rise and fall of fluid in the first reservoir to thus increase and decrease the pressure in the respective pump chambers and wherein the intake ports of the respective chambers are connected to second and third reservoirs containing liquids such that said pumps pump the liquids from the second and third reservoir through the discharge ports of each said pump.

4. A fluid pump system according to claim 3 wherein the intake port of one of the pump chambers is connected to the second fluid reservoir and the discharge port to the first reservoir and wherein the intake port of the second pump is connected to the third reservoir and the discharge port arranged to discharge fluid pumped from the third reservoir onto an absorbent wick.

5. A fluid pump system according to claim 4 wherein the first reservoir contains an aperture and the wick is positioned over the aperture.

* * * * *